US012442605B1

(12) United States Patent
Brien

(10) Patent No.: US 12,442,605 B1
(45) Date of Patent: Oct. 14, 2025

(54) BARREL COOLING BLOCK FOR A SEMI-AUTOMATIC RIFLE

(71) Applicant: Raymond Brien, Scottsdale, AZ (US)

(72) Inventor: Raymond Brien, Scottsdale, AZ (US)

( * ) Notice: Subject to any disclaimer, the term of this patent is extended or adjusted under 35 U.S.C. 154(b) by 0 days.

(21) Appl. No.: 19/238,406

(22) Filed: Jun. 14, 2025

(51) Int. Cl.
*F41A 13/12* (2006.01)
*F41A 21/24* (2006.01)
*F41A 21/44* (2006.01)

(52) U.S. Cl.
CPC ..... *F41A 13/12* (2013.01); *F41A 21/24* (2013.01); *F41A 21/44* (2013.01)

(58) Field of Classification Search
CPC ..... F41A 13/12; F41A 21/24; F41A 21/44
See application file for complete search history.

(56) References Cited

U.S. PATENT DOCUMENTS

| | | | | |
|---|---|---|---|---|
| 7,464,496 | B1 * | 12/2008 | Davies | F41A 21/24 42/75.02 |
| 9,207,031 | B2 * | 12/2015 | Balthaser | F41A 13/12 |
| 9,410,757 | B2 | 8/2016 | Miller | |
| 9,796,057 | B2 | 10/2017 | Tertin | |
| 10,161,700 | B2 * | 12/2018 | Klett | F41A 13/12 |
| 10,386,146 | B2 | 8/2019 | Spector | |
| 10,386,148 | B1 | 8/2019 | Handrick | |
| 10,866,051 | B2 | 12/2020 | Thompson | |
| 11,578,941 | B2 | 2/2023 | Hart | |
| 11,635,271 | B2 | 4/2023 | Lagenbeck | |
| 2003/0010187 | A1 * | 1/2003 | Muirhead | F28F 1/20 89/14.1 |
| 2005/0262997 | A1 * | 12/2005 | Brixius | F41A 13/06 89/14.1 |
| 2014/0076135 | A1 * | 3/2014 | Balthaser | F41A 13/12 89/14.1 |
| 2014/0082990 | A1 * | 3/2014 | Lee | F41A 21/44 42/96 |
| 2016/0273861 | A1 * | 9/2016 | Langenbeck | F41A 21/24 |

FOREIGN PATENT DOCUMENTS

| | | | | |
|---|---|---|---|---|
| CN | 109084616 | | 12/2018 | |
| CN | 109084616 | A * | 12/2018 | F41A 13/12 |
| DE | 2001938 | | 7/1970 | |
| DE | 2001938 | A1 * | 7/1970 | |
| GB | 374502 | | 6/1932 | |
| GB | 374502 | A * | 6/1932 | F41A 21/24 |
| GB | 519070 | | 3/1940 | |
| GB | 519070 | A * | 3/1940 | F41A 21/24 |
| GB | 2613883 | | 6/2023 | |
| GB | 2613883 | A * | 6/2023 | F41C 23/16 |
| KR | 20150005738 | | 1/2015 | |
| KR | 20150005738 | A * | 1/2015 | F41A 21/24 |
| RU | 2689091 | C1 * | 5/2019 | F41A 13/12 |

* cited by examiner

*Primary Examiner* — Gabriel J. Klein
(74) *Attorney, Agent, or Firm* — Mark V. Loen

(57) ABSTRACT

The invention is a cooling block that is added to a semi-automatic rifle to improve the cooling of the barrel. The cooling block is designed to fit into an air-cooling shroud and sit tightly against the gun barrel. The tolerances for the contact surface between the cooling block and the outer gun are critical for optimal cooling, and the block is designed for easy replacement to provide more continuous cooling.

10 Claims, 2 Drawing Sheets

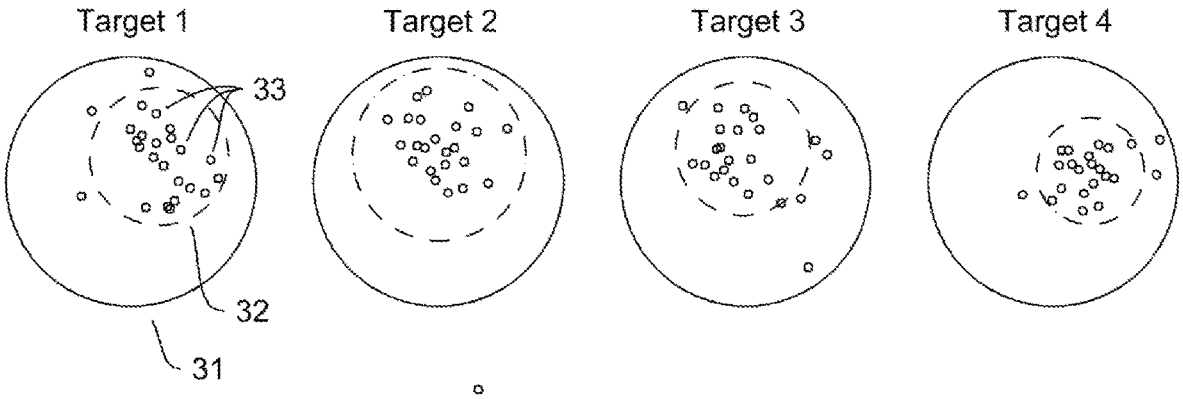
FIG. 3
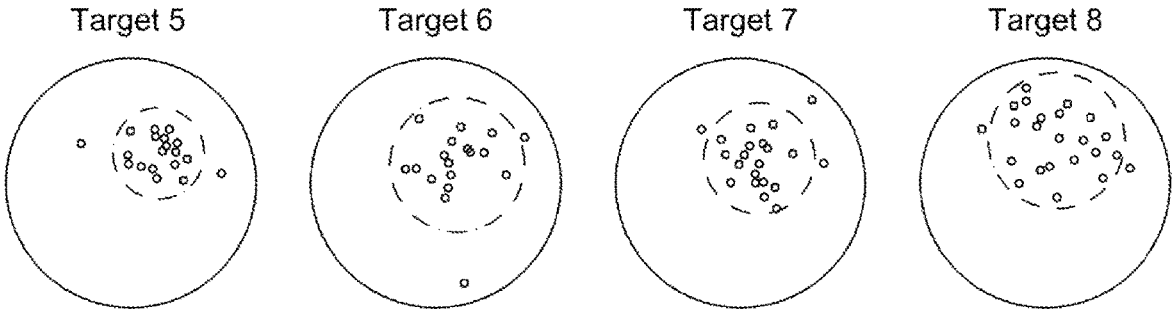
FIG. 4
| Table 1 | | | |
|---|---|---|---|
| Metal | Specific Heat J/kg-K | Thermal Conductivity W/m-K | Density g/cm$^3$ |
| Silver | 235 | 406 | 10.5 |
| Copper | 385 | 401 | 9.3 |
| Gold | 129 | 318 | 19.3 |
| Aluminum | 897 | 237 | 2.7 |
FIG. 5

BARREL COOLING BLOCK FOR A SEMI-AUTOMATIC RIFLE

RELATED APPLICATIONS

Not applicable.

STATEMENT OF GOVERNMENT INTEREST

Not applicable.

BACKGROUND OF THE INVENTION

(1) Field of the Invention

This invention is directed to the field of firearms, and particularly field cooling of gun barrels which heat up due to rapid firing.

(2) Description of Related Art

The heating of a gun barrel due to rapid firing is well known in the art. When the barrel is hot, the hot air surrounding the barrel will cause a distortion in the target view, causing the visual target position to be inaccurate. The heated barrel will also have additional wear at higher temperatures, and precision will degrade.

These effects, and others, have been addressed to some degree. U.S. Ser. No. 10/584,933B2 adds flutes to the gun barrel to improve cooling air flow. Similarly, US20160273861 discloses the use of fins connected to the barrel to improve cooling.

An exemplary semi-automatic rifle is the FN M249S®, which is a version of a prior light machine gun, originally developed by FN Herstal. The barrel cooling design includes an adjustable gas system, which has two settings for normal and adverse operating conditions. The air-cooling design amounts to a cooling shroud that provides better air flow.

Though current designs provide air cooling, the barrel will soon heat up to a level that will make it too hot to fire. There is a need in the art for an air-cooled barrel which includes a supplemental cooling that will rapidly remove heat.

SUMMARY OF THE INVENTION

The invention is a metal cooling block that is added to a semi-automatic rifle to improve the cooling of the barrel. The cooling block is designed to fit into an air-cooling shroud and sit tightly against the gun barrel. The tolerances for the contact surface between the cooling block and the outer gun are critical for optimal cooling, and the block is designed for easy replacement to provide more continuous cooling.

BRIEF DESCRIPTION OF FIGURES

FIG. 3 shows current shooting precision of an uncooled barrel for a sequential series of 25 shots in each of four targets.

FIG. 4 shows improve shooting precision of a cooled barrel for a sequential series of 25 shots in each of four targets.

FIG. 5 is a table showing desirable thermal properties of highly conductive metals.

DETAILED DESCRIPTION OF THE INVENTION

Figure 1:
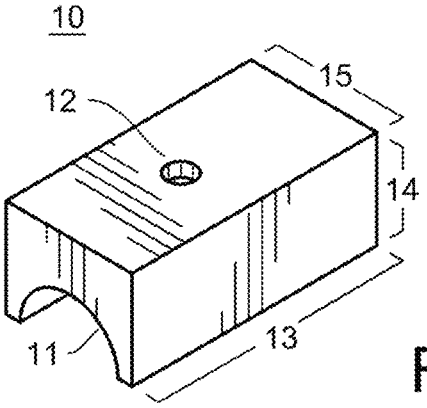
FIG. 1 shows a preferred design of the barrel cooling block.
Figure 2A:
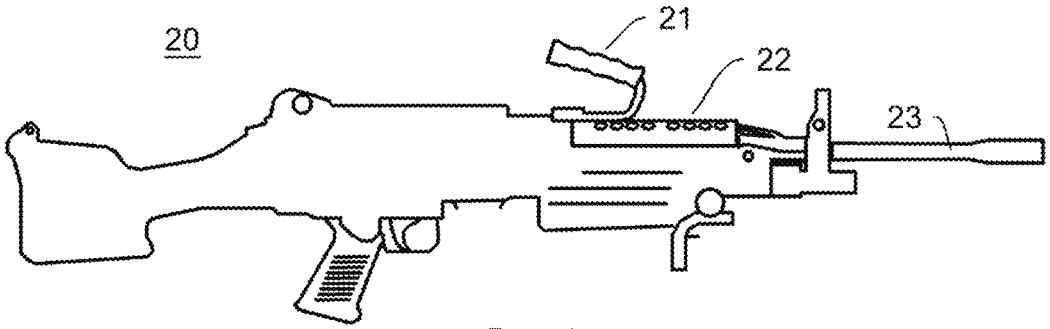
FIGS. 2A-2B show the position of the barrel cooling block on the rifle.
Figure 2B:
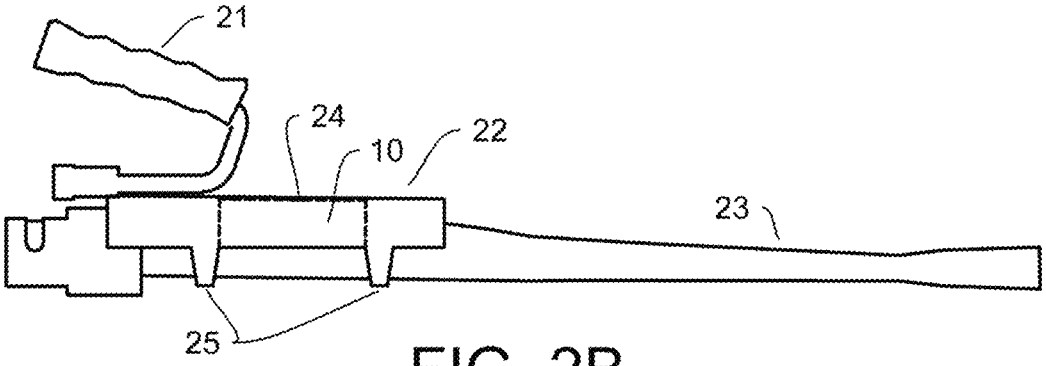

The labels shown in FIG. 1 are:

10 Barrel Cooling Block
11 Contact Surface from a Half Cylindrical Cutout
12 Hole for positioning pin
13 Length of Barrel Cooling Block
14 Height of Barrel Cooling Block
15 Width of Barrel Cooling Block The labels shown in FIGS. 2A and 2B are

20 Semi-Automatic Rifle
21 Lift Handle
22 Air Cooling Shroud
23 Barrel
24 Cooling Block Positioning Pin
25 Shroud Barrel Spring Clips
31 Cardboard Target Size
32 Circular Statistical fit of Average Shot Position and Spread
33 Shot Holes Through the Target.

In FIG. 1, the cooling block 10 is shown. The block has a width 15, a height 14, and a length 13. It includes a pin alignment hole 12 for convenient alignment when changing cooling blocks. The block has a contact surface 11 which connects to the rifle barrel, and the radius tolerance is very important for best heat conductivity. A typical contact diameter is 0.8750 inches which is centered on the cooling block width of 1⅛ inches. The block length is about 2³⁄₁₆ inches and the height is about ⅞ inches. The tolerance on the radius to the barrel outside dimension is critical to the design at +0.0005".

In FIG. 2A, a semi-automatic rifle 20 is shown. The important features are the barrel 23, the air-cooling shroud 22, and the shroud handle 21. FIG. 2B is a close up of the shroud and the cooling block 10. The cooling block is positioned which provides cooling. It is positioned between two shroud barrel clips 25, and a pin 24 on the shroud is inserted into the pin alignment hole 12.

The shroud barrel clips position the cooling block closer to the higher temperature part of the barrel during firing.

In the table of FIG. 5, copper is the preferred choice for affordability as well as high conductivity and a high amount heat storage per kg of metal. Brass and other alloys are similar in properties. Aluminum and aluminum alloys are an alternate cooling metal for lighter weight.

A copper cooling block weighs a little less than 0.4 lbs, and multiple firing blocks can be used in sequence for longer firing runs.

FIGS. 3A-3D show a precision test when firing the rifle without cooling, and FIGS. 4A-D show the results with cooling. The test goal was to measure precision improvement between uncooled and cooled rifle barrels.

The experiment comprised a series of firing 25 rounds into each of four cardboard targets (100 rounds total) in sequence without cooling. It was necessary to keep each target restricted to 25 rounds, due to target over-tearing. Over-tearing makes it difficult to record/measure shot placement. To determine the improvement in precision, the rifle was allowed to cool, and the cooling block was added to the barrel. Another four cardboard targets were fired upon with 25 rounds each. The pictures were then analyzed to determine the improvement in precisions in an uncooled (FIGS. 3A-3D) and cooled (FIGS. 4A-4D).

For the test, the gun was held in place by a rigid structure, and the gun was not re-aimed to the target when the target was replaced. The goal of the experiment was precision, not accuracy. Typically, when firing, the semi-automatic rifle is continuously re-aimed by the shooter, so accuracy was considered to be unimportant for the test.

A typical target 31 with shot placements 33 was analyzed to determine a circular statistical fit of the average shot position and spread. The dashed circle 32 represents the analysis. It is positioned based on the average shot distance to the target center. The circle diameter is based on one standard deviation of shot position variance. The sum of the dashed circle areas for all for targets are then used to determine the improvement.

Robin hood shots were not included in the analysis. That is, a shot that went through the hole of a prior shot. The experimental judgement was that robin hood shots would not significantly affect the results.

The overall result was a total area reduction of 27% for the cooled barrel with one standard deviation at 4%. This amounts to a precision improvement due to cooling in the range of 19-35% based on two standard deviations.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

The invention claimed is:

1. A metal block cooling system that improves precision of a semi-automatic rifle comprising:

A) a metal cooling block having a block height, a block width, and a block length, B) said metal cooling block having a halved cylinder cutout along said block length, said metal cooling block having desirable thermal characteristics for heat transfer and heat absorbing, C) said metal cooling block having a pin positioning hole on a surface opposite of said halved cylinder cutout, D) a shroud positioned above said rifle barrel and attached to said rifle barrel by a pair of shroud spring clips, E) said shroud incorporates a block positioning pin, G) said metal cooling block is positioned on said rifle barrel according to:

i) being between said pair of shroud spring clips, ii) by placing said halved cylinder cutout on top of said rifle barrel, and iii) said block positioning pin being inserted into said pin positioning hole, H) whereby said metal cooling block provides additional cooling when said semi-automatic rifle is fired and said metal cooling block provides an improvement in shooting precision by 19% to 35% inclusive.

2. The metal block cooling system of claim 1, wherein said metal cooling block substantially comprises copper or aluminum.

3. The metal block cooling system of claim 2, wherein said metal cooling block includes alloying metals.

4. The metal block cooling system of claim 1, wherein said halved cylinder cutout has a radius tolerance of +/− of 0.0005 inches.

5. The metal block cooling system of claim 4, wherein said halved cylinder cutout has a radius of 0.8750 inches.

6. A method that improves precision of a semi-automatic rifle, comprising:

A) providing:

i) a metal cooling block having a block height, a block width, and a block length, ii) said metal cooling block having a halved cylinder cutout along said block length, said metal cooling block having desirable thermal characteristics for heat transfer and heat absorbing, iii) said metal block having a pin positioning hole on a surface opposite of said halved cylinder cutout, iv) a shroud positioned above said rifle barrel and attached to said rifle barrel by a pair of shroud spring clips, v) said shroud incorporates a block positioning pin, B) placing said metal cooling block on said rifle barrel according to:

i) being between said pair of shroud spring clips, ii) by positioning said halved cylinder cutout on top of said rifle barrel, and iii) said block positioning pin being inserted into said pin positioning hole, C) whereby said metal cooling block provides additional cooling when said semi-automatic rifle is fired and said metal cooling block provides an improvement in shooting precision by 19% to 35% inclusive.

7. The method of claim 6, wherein said metal cooling block substantially comprises copper or aluminum.

8. The method of claim 7, wherein said metal cooling block includes alloying metals.

9. The method of claim 6, wherein said halved cylinder cutout has a radius tolerance of +/− of 0.0005 inches.

10. The method of claim 9, wherein said halved cylinder cutout has a radius of 0.8750 inches.

* * * * *